US005542235A

United States Patent [19]

Konstandin

[11] Patent Number: 5,542,235

[45] Date of Patent: Aug. 6, 1996

[54] METHOD AND APPARATUS FOR MANUFACTURING A BLISTER CARDBOARD PACK

[75] Inventor: Horst Konstandin, Karlsbad, Germany

[73] Assignee: PVT Piepenbrock Verpackungstechnik GmbH, Osnabruck, Germany

[21] Appl. No.: 204,966

[22] Filed: Mar. 2, 1994

[30] Foreign Application Priority Data

May 3, 1993 [DE] Germany ..... 43 06 996.7

[51] Int. Cl.[6] ..... B65B 47/00

[52] U.S. Cl. ..... 53/454; 53/157; 53/560; 53/173

[58] Field of Search ..... 53/156, 157, 454, 53/453, 560, 559, 173, 170

[56] References Cited

U.S. PATENT DOCUMENTS

| | | | |
|---|---|---|---|
| 3,512,332 | 5/1970 | Klein | 53/559 |
| 4,726,173 | 2/1988 | Giatti | 53/559 |
| 5,081,816 | 1/1992 | Cardinali | 53/559 |
| 5,203,455 | 4/1993 | Hewelt et al. | 206/333 |
| 5,207,050 | 5/1993 | Fulkerson et al. | 53/157 |

FOREIGN PATENT DOCUMENTS

| | | |
|---|---|---|
| 1991437 | 5/1968 | Germany . |
| 1479279 | 5/1970 | Germany . |
| 2160534 | 6/1973 | Germany . |
| 448485 | 4/1968 | Switzerland . |
| 472316 | 6/1969 | Switzerland . |
| 966625 | 8/1964 | United Kingdom . |
| 1019963 | 2/1966 | United Kingdom . |
| 1522403 | 8/1978 | United Kingdom . |

*Primary Examiner*—Dowell A. Larson
*Assistant Examiner*—Gene L. Kim
*Attorney, Agent, or Firm*—Banner & Allegretti, Ltd

[57] ABSTRACT

In a method and an appliance for manufacturing a blister pack having a carboard inlay (blister cardboard pack) a blister pack is provided as an endless tape having the products sealed in blisters. At a unification station a cardboard inlay having recesses for the blisters of the blister pack and having in the direction of conveyance of the blister pack substantially the length of a blister cardboard pack, is placed true-to-size on the blister pack tape, the recesses of the cardboard inlay surrounding the blisters of the blister pack. By a feed pawl, a holding collet and outfeed rollers the blister pack tape is fed to the unification station incrementally and further conveyed incrementally after placement of the cardboard inlay. In a sealing station the cardboard inlay is sealed to the blister pack tape. Subsequently the individual blister cardboard packs are separated from the blister cardboard pack tape in a cutting station.

25 Claims, 3 Drawing Sheets

METHOD AND APPARATUS FOR MANUFACTURING A BLISTER CARDBOARD PACK

TECHNICAL FIELD

The present invention relates to a method for manufacturing a blister pack having a cardboard inlay (blister cardboard pack).

BACKGROUND OF THE INVENTION

Blister cardboard packs are known as such, particularly in the medical sector, where they serve for packaging medications such as tablets and the like. One such blister cardboard pack BK is illustrated in FIG. 1. It comprises substantially a blister pack B and a cardboard inlay K, the latter being sealed to the blister pack and serving to reinforce the blister pack as well as to carry information, for example, as to how and how often the medication is to be administered and as to indications of the manufacturer.

In the medical sector the blister pack B is also used by itself for packaging and presenting medical preparations such as tablets and the like. This blister pack is fabricated in a known blister pack production machine 1 as illustrated in FIG. 2. In this arrangement the tablets are sealed between two tapes of film which are later punctured or separated from each other when a tablet is removed. The endless blister pack tape is separated into individual sections in or following the blister pack production machine 1, each section containing one or more tablets, whereby the sections are subsequently inserted into a collation package.

The blister pack B used as a basis of the present invention comprises a bottom film, which is fabricated for example of PVC and which is provided with the blisters N for the product to be inserted. These blisters are formed from the bottom film in the blister pack production machine 1. On to this bottom film a second film or cover film is sealed by means of seal coating which, for opening the blister pack to permit removal of a tablet, is stripped from the bottom film. In turn this second seal film is usually made up of several layers, for example a polyester layer, a metal foil layer and a layer of paper. On the side of the cover film facing the bottom film the first layer is the polyester layer which constitutes the weak point for stripping the cover film from the bottom film. This is topped by the metal foil layer, for instance a layer of aluminium foil, which closes off the tablet air and water tight in the blisters. To enhance stability against the cover film being forced through, the layer of paper may be additionally provided on the layer of metal foil. On the layer of polyester the seal coating is provided, by means of which the seal film is sealed to the bottom film.

If this blister pack B is now to be used not by itself but instead together with a cardboard inlay K to reinforce the blister pack and for the purpose of presenting information, it was hitherto normal practice in the fabrication of such a blister cardboard pack BK to apply the additional cardboard to the blister pack manually or with the aid of simple tools. To do this, the blister pack tape formed in the blister pack production machine 1 is first cut into separate sections which have the final size of the blister cardboard pack. Then the cardboard inlay is manually placed on the blister pack on the side of the bottom film having the blisters. For this purpose openings or recesses are provided in the cardboard inlay at the locations of the blisters which surround and receive the blisters on placement of the cardboard inlay. Alternatively the blister cardboard pack formed in this way may subsequently be provided with a longitudinal and/or transverse arrangement of perforations P. By means of these perforation lines sections for individual administrations, e.g. for a single tablet, may be formed, the individual section permitting separation from the blister cardboard pack. To facilitate removal of the tablet from the separated individual section further recesses E may be provided in the cardboard inlay and in the bottom film of the blister pack at the cross points of the perforation lines P, i.e. between neighboring blisters N. At these further recesses E the cover film of the blister pack B is not covered by the cardboard inlay K and the bottom film of the blister pack, it instead remaining free. After separation of an individual section from the blister cardboard pack BK one such free remaining part of the recess E of the cardboard inlay and of the bottom film is then to be found on at least one corner of said individual section. By finger picking this free end the cover film of the blister pack can be stripped from the bottom film of the blister pack provided with the blisters, thus opening the blister and enabling the tablet to be removed. The important thing in this respect is that the bottom film of blister pack B having the blisters remains connected to the cardboard inlay K.

Since the cardboard inlay of the blister cardboard pack as fabricated hitherto by usual means is placed manually on a blister pack section separated from a blister pack tape produced in a blister pack production machine 1, problems exist with this method due to lack of precision in holding and guiding the blister pack sections and the cardboard inlay as well as due lack of accuracy in adjusting and alignment of the cardboard inlay relative to the blister pack section. As a result of these mechanical and manual inaccuracies or inadequacies difficulties are experienced in the production of the blister cardboard pack. Especially when the cardboard inlay is placed offset sideways from the blister pack section, the recesses of the cardboard inlay fail to surround the blisters of the blister pack fully or correctly, resulting in a faulty blister cardboard pack being produced. After placement of the cardboard inlay on the blister pack section the perforation for forming the individual sections cannot be performed in this intermediate condition due to lack of proper holding or guidance of the blister cardboard pack, this also being the cause for faulty packs. This manual production process is inconvenient, unreliable, time-consuming and expensive due to the high reject rate and also due to the high manpower requirement involved.

SUMMARY OF THE INVENTION

The object of the present invention is thus to accelerate and enhance reliable production of a blister cardboard pack in applying a cardboard inlay to a blister pack by reducing rejects and saving costs and manpower.

This object is achieved by a method and an apparatus for the production of a blister cardboard pack. After the provision of blister packs having blisters as an endless tape, and cardboard inlays having recesses for the blisters of the blister pack and roughly the length of a blister cardboard pack, the blister pack tape is fed incrementally to a unification station in which a cardboard inlay is applied true-to-size on the blister pack tape, whereby the recesses of the cardboard inlay surround the blisters of the blister pack. Then the blister pack tape is joined to the cardboard inlay to make a blister cardboard pack tape and incremented further. In conclusion the blister cardboard pack tape is separated into individual sections having the length of a single blister cardboard pack.

By these means of the invention an automated method and a corresponding apparatus for the production of a blister cardboard pack are created by means of which, unlike prior art, single cardboard inlays are placed on the non-separated endless blister pack tape and sealed thereto. Only then is the resulting blister cardboard pack tape separated into individual blister cardboard pack sections. The blister pack tape is thus made use of to guide and position the blister cardboard packs formed in conclusion. Depending on the particular application this method can be performed on a single blister pack tape or on several blister pack tapes running parallel to each other. In addition to this, the blisters of the blister pack as well as the recesses of the cardboard inlay can be of any shape, depending on the product to be sealed in the blisters.

Further features and advantages of the invention will become apparant from a reading of the Detailed Description below in conjunction with the claims and the drawings.

DETAILED DESCRIPTION

Figure 2:
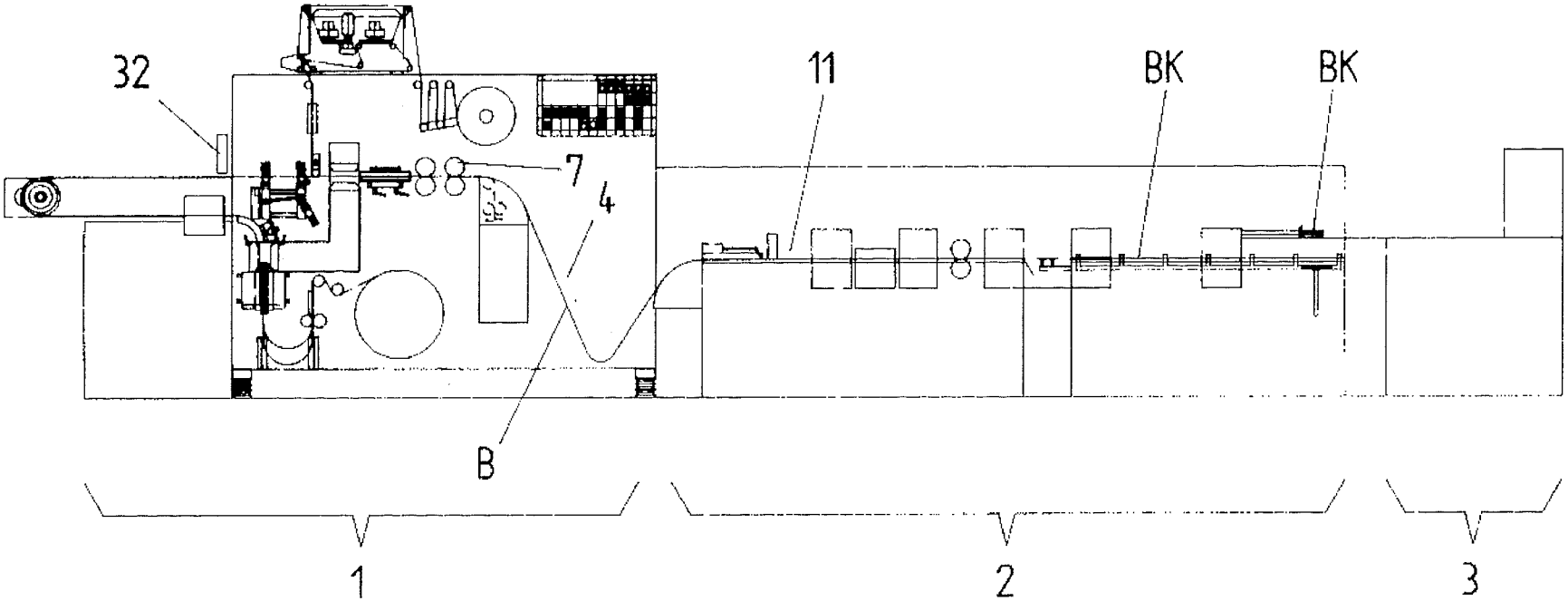
FIG.2 is a schematic view of the complete apparatus for manufacturing a blister cardboard pack.
Figure 3:
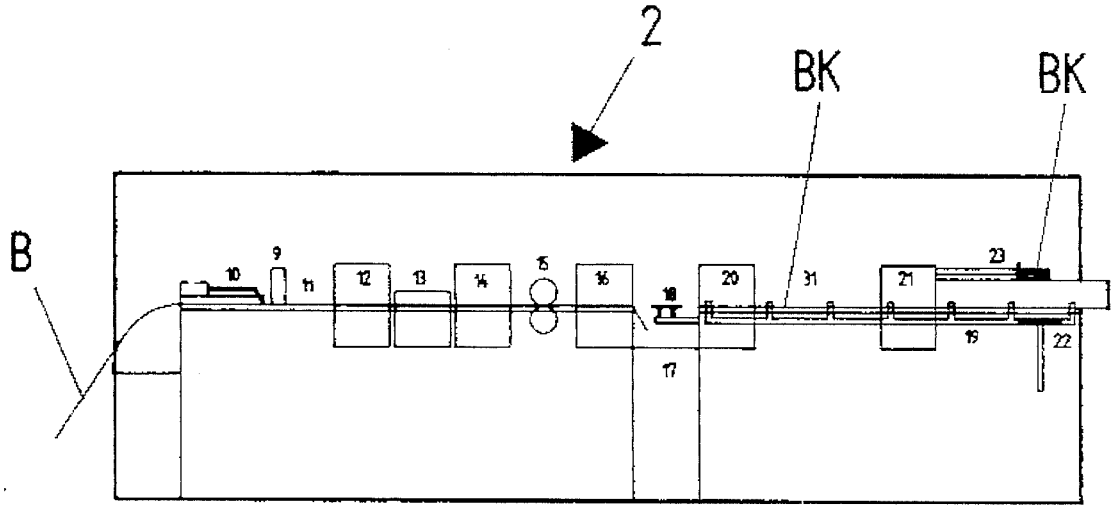
FIG. 3 is a schematic, magnified side view of the apparatus according to the invention for manufacturing a blister cardboard pack.

As illustrated by FIG. 2 the complete apparatus for manufacturing a blister cardboard pack comprises a conventional blister pack production machine 1, to which the blister cardboard pack production machine 2 according to the invention, i.e. the apparatus for unifying the blister pack with the cardboard inlay and for separating the formed blister cardboard pack tape into individual blister cardboard pack sections, is connected. At the end of this packaging line a stacker packing machine 3 may be provided.

In the conventional blister pack production machine 1 the blister pack B, as described above, is fabricated as an endless tape. The blisters of the blister pack in which the product, such as, for example, tablets and the like, is sealed face downwards at the output of the machine 1. So that in a later step in manufacture the cardboard inlay K can be placed from above on the blister pack tape the latter is turned over thru 180° about an axis in a turnover sector 4 at the output of the blister pack production machine 1, said axis being substantially parallel to the direction of conveyance of the blister pack tape so that the blisters of the blister pack subsequently face upwards. The ability to accomplish the specific task of turnover sector 4, i.e., turning the packaging material about 180°, including providing any necessary structure, is conventional in the packaging industry and is known for turning strips of foil and other packaging material. The turned-over blister pack tape B is then fed to the blister cardboard pack production machine 2, thus ensuring that the blister pack tape is always correctly located for each step in manufacture. For filling the blisters with the product they face downwards in the blister pack production machine 1. After turning over of the blister pack tape the blisters face upwards for placement of the cardboard inlay in the blister cardboard pack production machine 2.

In the blister cardboard pack production machine 2 a unification station 11 is provided in which the cardboard inlay K is placed on the blister pack tape B. For this purpose the cardboard inlay is made available at this unification station 11, said cardboard inlay having recesses to receive the blisters of the blister pack. In the direction of conveyance of the blister pack the cardboard inlay has substantially the length of a single blister cardboard pack BK, more particularly slightly longer than a blister cardboard pack. By means of a feed pawl or collet 10 arranged ahead of the unification station 11 in the direction of conveyance of the blister pack in conjunction with a holding collet 9 as well as by means of outfeed rollers 15 arranged downstream of the unification station 11 in the direction of conveyance of the blister pack the blister pack tape B is fed to the unification station 11 in increments each substantially corresponding to the length of a single blister cardboard pack BK, more particularly in increments which are slightly longer than a single blister cardboard pack. Also by means of these conveying members the blister cardboard pack tape formed by placement of the cardboard inlay K on the blister pack tape B is fed further downstream of the unification station 11 again in increments having substantially the length of a blister cardboard pack in each case. The feed pawl 10, the holding collet 9 and the outfeed rollers 15 thus run in synchronism to each other.

By means of the feed pawl 10 the blister pack B is positioned upstream of the unification station 11 relative to the cardboard inlay K. For this purpose the feed pawl 10 grips the front end of the blisters N of the blister pack which are frontmost in the direction of conveyance, by it executing a short movement contrary to the direction of conveyance of the blister cardboard pack tape. Due to the pull of the outfeed rollers 15 the blister pack tape is then further conveyed by a travel limited by the feed pawl 10 corresponding to the length of a single blister cardboard pack section to be formed. Accordingly, the horizontal stroke of the feed pawl dictates the feed of the blister pack tape executed in a single conveyance increment. At the end of its horizontal movement in the direction of conveyance the feed pawl 10 releases upwards from the blister pack tape and returns above the latter contrary to the direction of conveyance back to its starting position to grip the blisters of the next blister cardboard pack to be formed. During this phase, i.e. between two forward strokes of the feed pawl 10, the (until this time released) holding collet 9 firmly holds the blister pack tape against any further forwards movement due to the pull of the outfeed rollers 15. For this purpose the outfeed rollers 15 are provided with a slip clutch. Whilst the drive of the outfeed rollers 15 is continuously running, the rollers themselves come to a halt, when the holding collet 9 or the feed pawl 10 hold the blister pack tape against further feed. The blister pack tape then exterts such a force on the outfeed rollers 15 that their slipping clutch is disengaged and the rollers come to a halt. When the force of the holding collet 9 or of the feed pawl 10 is eliminated, i.e. when released from the blister pack tape, the slip clutch of the outfeed rollers 15 is reengaged. The outfeed rollers 15 then again produce the pull necessary to move the blister pack tape over the stroke travel and on in the direction of conveyance at roughly the feed speed of the feed pawl 10. The outfeed rollers 15 thus produce the actual feed pull whilst the feed pawl 10 determines the admissible stroke travel. Instead of the slip clutch at the outfeed rollers 15 a suitably acting electronic element may also be provided.

In the unification station 11 the cardboard inlay K is placed properly located on the blister pack tape B, the recesses of the cardboard inlay surrounding the blisters N of the blister pack B. According to the example of a first embodiment, illustrated in FIG. 4, a rotary plate 25 is arranged alongside the unification station 11 for providing and placing the cardboard inlay K. In a first position of the rotary plate 25 the cardboard inlay is extracted from a crib 26. Following further rotation of the rotary plate 25 to a second cardboard folding position 27 it is alternatively possible that one part of the cardboard inlay may be folded over another part of the cardboard inlay. In this case and following further rotation of the rotary plate 25 to a third cardboard sealing position 28 the parts of the cardboard inlay folded one on the other are sealed together. By means of these parts of the cardboard inlay folded one on the other and sealed together a pouch, for instance, can be formed. In conclusion the rotary plate 25 is further rotated to a last cardboard removal position 29 in which the cardboard inlay is removed from the rotary plate 25 and placed on the blister pack tape. For this purpose a turnover plate 30 which turns the cardboard inlay thru 180° about an axis running parallel to the direction of conveyance of the blister pack tape, placing the cardboard inlay sideways and from above properly located on the blister pack tape, the recesses in the cardboard inlay surrounding the blisters of the blister pack. The side of the cardboard inlay facing upwards on the rotary plate 25 is thus turned over to face downwards, it then being in contact with the blister pack tape.

Figure 4:
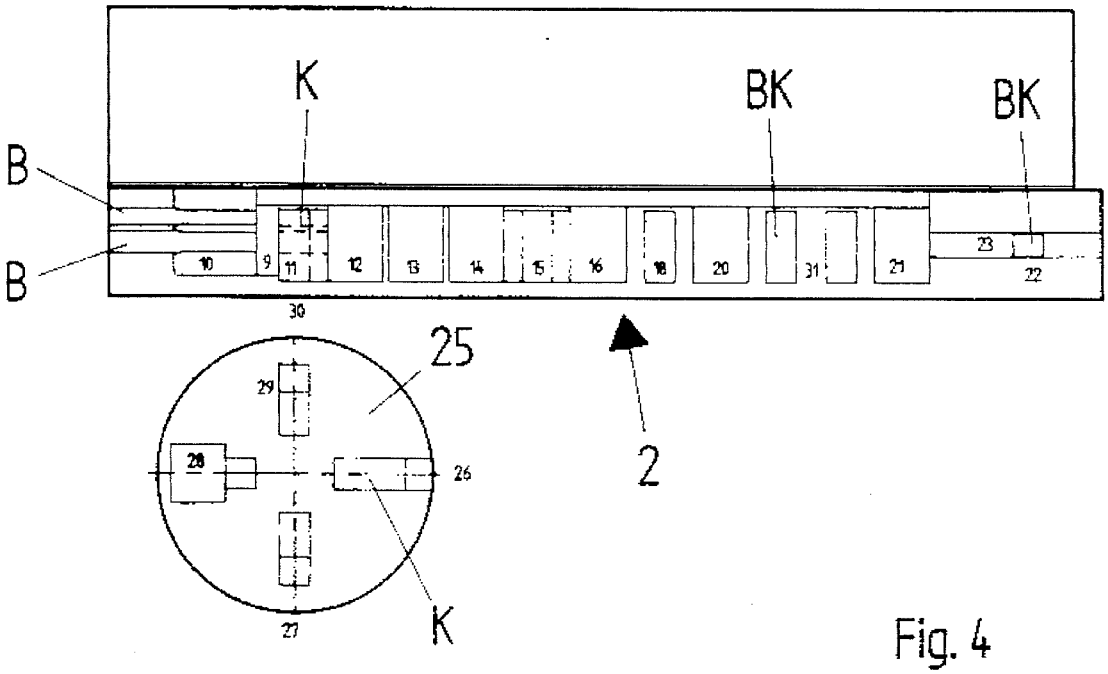
FIG.4 is a schematic, magnified plan view of the apparatus according to the invention for manufacturing a blister cardboard pack.

As an alternative to the example embodiment illustrated in FIG. 4, in which the cardboard inlay is provided sideways alongside the unification station 11, moved transversely to the direction of conveyance of the blister pack tape and placed from above on the blister pack tape, the cardboard inlay may be provided in a crib arranged above the unification station 11, it then being taken from the crib for placement from above on the blister pack tape. In both cases the cardboard inlay may also be placed without the previously formed pouch. This could then be formed in one of the following stations on the feed line by folding and sealing the parts of the cardboard inlay as detailled below.

Following placement of the cardboard inlay K on the blister pack tape B in the unification station 11, these two components are joined to form a blister cardboard pack tape. For this purpose a sealing station 12 for sealing the blister pack tape to the cardboard inlay is provided following the unification station 11. In a cooling station 13 the thus formed blister cardboard pack tape is subsequently cooled. Following the cooling station 13 a perforating station 14 may be provided which perforates the blister cardboard pack tape in the longitudinal and/or transverse direction, to produce the aforementioned individual sections of the blister cardboard pack BK which can then be separated from the blister cardboard pack, for example, for individual dispensing of the medication therein.

If the blister cardboard pack is required to have an aforementioned pouch, one sealing station can be eliminated from the two example embodiments described above for placement of the cardboard inlay on the blister pack tape as an alternative to the two sealing stations for sealing the pouch and for sealing the cardboard inlay to the blister pack tape. Both sealing actions are then performed simultaneously in a single station which makes for a simpler and cheaper solution.

To form the final blister cardboard pack BK the individual sections having the length of a single blister cardboard pack are now separated from the blister cardboard pack tape which heretofor existed as an endless tape. For this purpose a cutting or stamping station 16 is provided to operate in synchronism with the incremental feed of the blister cardboard pack tape which cuts off the individual blister cardboard packs from the blister cardboard pack tape transversely to the direction of conveyance. In the cutting station 16 the individual blister cardboard packs are cut off e.g. with a U-shaped stamping knife precisely to the desired final length (e.g. 110 mm). Since the placed cardboard inlay is wider than this length, but on the other hand narrower (e.g. 115 mm) than the original blank size of the blister pack (e.g. 120 mm) narrow sections may exist on the blister cardboard pack tape at which only edge areas of the blister pack exist, but no cardboard inlay. In cutting off the desired blister cardboard packs with the stamping knife these sections of the blister pack between two blister cardboard packs in sequence remain as waste with two narrow carboard edge sections.

For the dimensions of the cardboard inlay and the blister cardboard pack cited here as an example the stroke travel of the feed pawl 10 amounts to 122.5 mm, for example.

The cutting or stamping station 16 is followed by suction elements 18 and conveyor means such as, for instance, stroke bars 19 for further conveyance of the formed blister cardboard packs BK. As illustrated in FIG. 2 the blister pack production machine 1 features a checking means 32 which already detects in manufacture of the blister pack whether a defective blister pack exists, e.g. one which is not fully sealed or one in which per pack unit one or more products are missing in the blisters. If the checking means 32 detects such a defective blister pack, it signals the rotary plate 25 such that it skips a sequence when the defective blister pack reaches the unification station 11 so that no cardboard inlay is placed on the blister pack tape. This checking means 32 also signals the sealing station 12, the cooling station 13, the perforating station 14 and the suction elements 18 so that these will not operate when such a defective blister pack arrives in them. In the sealing station 12 and the perforating station 14 synchronous clutches are provided for this purpose which are signalled by the checking means 32 and cause the corresponding station to cease operation when the blister pack formerly detected as being defective in the blister pack production machine arrives at this station. Accordingly only useful, good blister pack sections are joined to the cardboard inlay by sealing and subsequently perforated.

The suction elements 18 too, will also miss operation when the blister pack arrives as signalled defective to them by the checking means 32. For this purpose the blister cardboard pack tape still to be parted downstream of the cutting station 16 is advanced forward over a free intermediate space immediately prior to cutting off of the next blister cardboard pack so that roughly two-thirds to three-quarters of the blister cardboard pack length freely protrude. If the blister cardboard pack concerned is a good, useful one, then before cutting off the suction element 18 will accept, hold and further convey it to the stroke bar 19 after cutting off. If, however the blister pack concerned is defective the suction element 18 misses operation and the pack, after cutting, drops through the free intermediate space into a rejects bin 17. Sorting out defective packings in this way is necessary since the useful blister cardboard packs, after cutting off, are stacked and further packaged on the same packing line. Particularly in the case of high-quality, expensive sealed preparations, such as special medications for example, it is also necessary that such products be removed from defective blister packs collected as rejects and resealed in the blister pack production machine 1.

Figure 1:
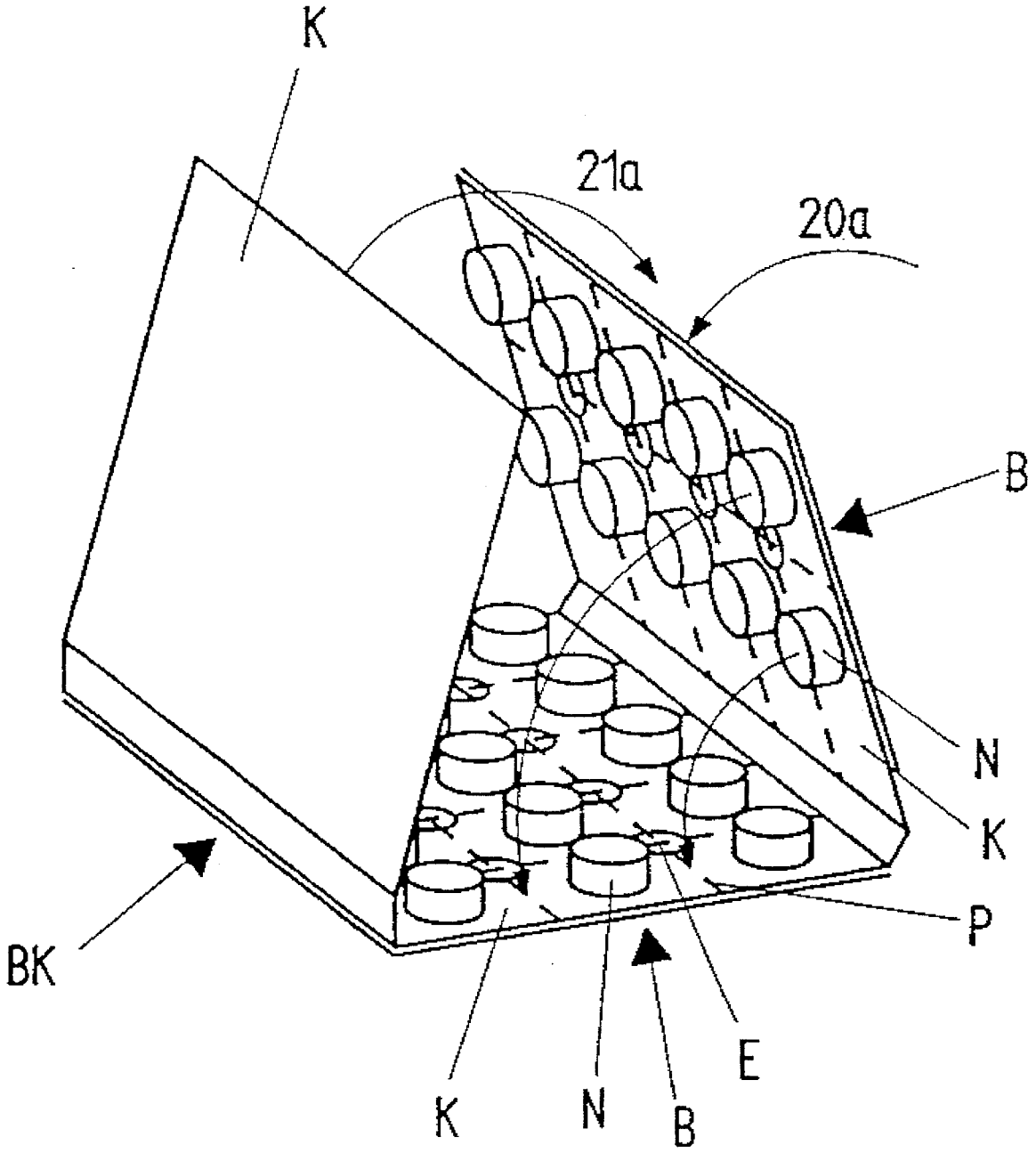
FIG. 1 is a perspective view of a blister cardboard pack produced by the method and the associated apparatus according to the invention.

For certain applications it is necessary that at least two blister pack tapes, the one independent of the other, pass through the blister cardboard pack production machine 2 in parallel, the cardboard inlay being placed on several or all of these tapes. Accordingly these tapes are joined together by the cardboard inlay. For this purpose a slitting or cutting means 7 is provided at the output of the blister pack production machine 1 which slits the hitherto integral uniform blister pack tape longitudinally into at least two blister pack tapes each separate from the other. To produce the blister cardboard pack BK illustrated in FIG. 1 two blister pack tapes B are necessary, each separate from and running parallel to each other. As shown in FIGS. 1 and 4 the one (upper or outer) blister pack tape is narrower than the other (lower or inner) blister pack tape. For example, the upper blister pack tape may have two rows of blisters N running one alongside the other in the direction of conveyance, whereas the lower blister pack tape has three rows of blisters N running one alongside the other in the direction of conveyance. In the unification station 11 the cardboard inlay K is placed to connect the two blister pack tapes B to each other. It is thus necessary that the cardboard inlay precisely matches the arrangement of blisters N on the two blister pack tapes B so that the recesses in the cardboard inlay K are able to surround these blisters N. To produce the blister cardboard pack BK shown in FIG. 1 the cardboard inlay K also has on its one side a projecting section which does not cover the blister pack tapes B and on which, for instance, a pouch is provided as already described above in conjunction with the rotary plate 25. In FIG. 4 this projecting section is located in the unification station beneath the lower or inner blister pack tape B.

After the individual blister cardboard packs BK have been cut off from the blister cardboard pack tape in the cutting station 16, they lie flat in the path of conveyance. To complete production of the blister cardboard pack BK as shown in FIG. 1 the upper or outer blister cardboard pack section and the side projecting section containing the pouch of the cardboard inlay need to be folded inwards over the inner blister cardboard pack section. For this purpose two folding stations 20, 21 in sequence are provided in the direction of conveyance, through which the blister cardboard pack BK is conveyed by means of stroke bars or dog racks 19. In the first folding station 20 the upper or outer blister cardboard pack section is folded sideways over the inner blister cardboard pack section (first fold 20*a* in FIG. 1). After further conveyance of the blister cardboard pack section folded as such by means of the stroke bars 19 into the section folding station 21, here the side projecting part of the cardboard inlay is folded over the two blister cardboard pack sections located one on the other (second fold 21*a* in FIG. 1). The blisters of the two blister cardboard pack sections are arranged and oriented one to the other in such a way that the two rows of blisters of the outer pack section located one alongside the other transversely to the direction of conveyance are located, after folding, in the spaces between the three rows of blisters of the inner pack section oriented one alongside the other transversely to the direction of conveyance. After folding the blisters of the two pack sections are thus located not on, but alongside each other, thus achieving a lower profile of the folded pack, meaning lesser space required in further packaging.

As an alternative a further inlay station 31 for inserting further inlays, such as prescription slips or leaflets for example, in the individual blister cardboard packs may be provided.

By means of the stroke bars or dog rakes 19 each blister cardboard pack is conveyed through the folding stations 20 and 21 and the inlay station 31. For this purpose the stroke bars have fingers which engage each blister cardboard pack front and rear for its guidance. The stroke bars 19 then convey each pack by half a stroke, substantially corresponding to the length of a pack, in the direction of conveyance, before dipping out of the way and returning back underneath the pack to their starting position, where they receive the next pack. As an additional, but not necessary safety means fixed fingers may be arranged between the stroke bars to hold and locate the individual packings when they have been released by the stroke bar in it returning to its starting position. In the example embodiment described herein having two blister cardboard pack tapes running parallel to each other two stroke bars having two fingers each may be provided alongside each other with several such pairs of fingers arranged in sequence in the direction of conveyance.

As an alternative to the stroke bars 19 other means of conveyance are, of course, feasible. One popular method makes use of dogged chain conveyors. Instead of these, toothed belts may be employed, on the backs of which dogs are placed, center-spaced accordingly. As yet a further alternative vacuum-type conveyor belts may be employed, comprising perforated or holed toothed belts, center-spaced accordingly, a vacuum pressure acting from beneath through the holes holding the conveyed product in place.

Following the folding stations 20, 21 the blister cardboard packs are stacked. A pusher 22 pushes the individual blister cardboard packs from the conveyor means 19 upward into a stack. Once a certain number of blister cardboard packs is attained, this stack is then ejected by a further pusher 23 into a conventional stack packaging machine 3. Here, the stack of blister cardboard packs goes through further processing, i.e. packaging in an envelope carton and checking, for example.

What is claimed is:

1. A method for manufacturing a blister cardboard pack having a blister pack and a cardboard inlay comprising the following steps:

a) providing an endless blister pack tape with blisters and having products sealed in the blisters;

b) providing a cardboard inlay having openings for the blisters of the endless blister pack tape, the cardboard inlay being substantially the length of a blister cardboard pack to be manufactured in a direction of conveyance at a unification station;

c) incrementally feeding the blister pack tape to a unification station in steps, each step having substantially the length of the blister cardboard pack to be manufactured;

d) placing the cardboard inlay on the blister pack tape, whereby the openings of the cardboard inlay surround the blisters of the blister pack tape;

e) joining the blister pack tape to the cardboard inlay to make a blister cardboard pack tape;

f) further incrementing the blister cardboard pack tape in steps, each step having substantially the length of the blister cardboard pack to be manufactured:

g) separating the blister cardboard pack tape into individual sections each having the length of a blister cardboard pack to be manufactured:

h) providing the blister pack tape with the blisters facing downwards; and i) turning the blister pack tape 180° about an axis located substantially parallel to the direction of conveyance of the blister pack tape so that the blisters face upwards, prior to being joined to the cardboard inlay.

2. The method as set forth in claim 1, wherein said incrementally feeding step and said further incrementing step are executed in common by conveyance members running in synchronism to each other in the following steps:

positioning of the blister pack tape upstream of the unification station relative to the cardboard inlay by means of a conveyance member engaging the front end of the frontmost blisters in the direction of conveyance;

further conveying the blister pack tape in the unification station by travel as dictated by the conveyance members; and further incrementing the blister cardboard pack tape downstream of the unification station by means of the conveyance members.

3. The method as set forth in claim 1, wherein the cardboard inlay providing step includes providing the cardboard inlay alongside the unification station and moving the cardboard inlay transversely to the direction of conveyance of the blister pack tape and the cardboard inlay placing step includes placing the cardboard inlay on the blister pack tape from above.

4. The method as set forth in claim 1, wherein the cardboard inlay placing step includes placing the cardboard inlay on the blister pack tape from above.

5. The method as set forth in claim 1, wherein the joining step comprises the following steps:

sealing the blister pack tape to the cardboard inlay; and subsequently cooling the sealed blister cardboard pack tape.

6. The method as set forth in claim 1, wherein said joining step also includes perforating the blister cardboard pack tape in one of the longitudinal and transverse directions.

7. The method as set forth in claim 1, further comprising the step of cutting off individual blister cardboard packs from the blister cardboard pack tape transversely to the direction of conveyance.

8. The method as set forth in claim 7, wherein the blister cardboard packs have first, second, and third parts joined to each other, and said cutting step is followed by the following steps:

further conveying the individual blister cardboard packs;

folding the first part of the individual blister cardboard packs over the second part of the individual blister cardboard packs;

inlaying at least one additional inlay in the individual blister cardboard packs;

folding the third part of the individual blister cardboard packs over the first and second parts of the individual cardboard packs and over said at least one additional inlay;

stacking several blister cardboard packs; and ejecting a stack of several blister cardboard packs into a stacker packing machine.

9. A method for manufacturing a blister cardboard pack having a blister pack and a cardboard inlay comprising the following steps:

a) providing an endless blister pack tape with blisters and having products sealed in the blisters;

b) providing a cardboard inlay having openings for the blisters of the endless blister pack tape, the cardboard inlay being substantially the length of a blister cardboard pack to be manufactured in a direction of conveyance at a unification station;

c) incrementally feeding the blister pack tape to a unification station in steps, each step having substantially the length of the blister cardboard pack to be manufactured;

d) placing the cardboard inlay on the blister pack tape, whereby the openings of the cardboard inlay surround the blisters of the blister pack tape;

e) joining the blister pack tape to the cardboard inlay to make a blister cardboard pack tape;

f) further incrementing the blister cardboard pack tape in steps, each step having substantially the length of the blister cardboard pack to be manufactured;

g) separating the blister cardboard pack tape into individual sections each having the length of a blister cardboard pack to be manufactured;

h) detecting defective blister packs by a checking device in a blister pack manufacturing device;

i) controlling the placing step by said checking device so that said placing step fails to occur upon the detection of defective blister packs; and j) rejecting defective blister packs in response to the detection of defective blister packs.

10. The method as set forth in claim 1, further comprising providing and incrementally feeding at least two independent blister pack tapes parallel to each other and joining the two independent blister pack tapes together by placing the cardboard inlay thereon.

11. The method as set forth in claim 10, further comprising separating a blister pack tape in the longitudinal direction into at least two blister pack tapes independent of each other.

12. The method as set forth in claim 10, further comprising a folding step including one of: folding one blister pack tape sideways over the other blister pack tape and folding a side projecting part of the cardboard inlay over the blister pack tapes.

13. An apparatus for manufacturing blister cardboard packs, each blister cardboard pack having a cardboard inlay and blisters in which a product is sealed, the cardboard inlays having openings for the blisters of its respective blister cardboard pack and being substantially the same length as its respective blister cardboard pack, said apparatus comprising:

a blister pack production machine for providing an endless blister pack tape with a plurality of blisters and having products sealed in the blisters;

a unification station having a placing device for placing a cardboard inlay with openings on the endless blister pack tape, the openings of the cardboard inlay surrounding blisters of the blister pack tape;

a joining device for joining the cardboard inlay to the blister pack tape to form a blister cardboard pack tape;

means for incrementally feeding the blister pack tape to the unification station and for incrementally conveying a formed blister cardboard pack tape including the blister pack tape and a cardboard inlay in a direction of conveyance downstream of the unification station;

means for separating the formed blister cardboard pack tape into individual blister cardboard packs; and a turnover region located between the blister pack production machine and the unification station in which the blister pack tape is turned 180° about an axis located substantially parallel to the direction of conveyance of the blister pack tape.

14. The apparatus as set forth in claim 13, wherein said blisters of said blister pack tape includes frontmost blisters having front ends in said direction of conveyance, said incremental feeding and conveying means comprise a feed pawl, a holding collet and outfeed rollers running in synchronism with each other, the feed pawl engaging the front end of the frontmost blisters to position the blister pack tape upstream of the unification station relative to the cardboard inlay, and the feed pawl and the outfeed rollers conveying the blister pack tape incrementally by a distance dictated by the feed pawl to the unification station and further conveying the blister cardboard pack tape downstream of the unification station.

15. The apparatus as set forth in claim 14, wherein the feed pawl is movable between a first starting position and a second position, the outfeed rollers providing a force to the blister pack tape for conveying the blister pack tape in the direction of conveyance, the holding collet is controlled so that it holds the blister pack tape against the force of the outfeed rollers whilst the feed pawl has released from the blister pack tape and returns to its starting position.

16. The apparatus as set forth in claim 14 further comprising:

a rotary plate adjacent the unification station to provide the cardboard inlay, the rotary plate including a crib removal position for removal of the cardboard inlay from a crib; and a discharge and placement position for removing the cardboard inlay from the rotary plate and for placement thereof on the blister pack tape.

17. The apparatus as set forth in claim 16, further comprising a turnover mechanism located adjacent the discharge and placement position which turns the cardboard inlay 180° about an axis parallel to the direction of conveyance of the blister pack tape and places it from above on the blister pack tape.

18. The apparatus as set forth in claim 13, further comprising a crib arranged above the unification station for providing the cardboard inlay from which the cardboard inlay is placed on the blister pack tape from above.

19. The apparatus as set forth in claim 13, wherein the joining device includes a sealing station for sealing the blister pack tape to the cardboard inlay and a cooling station.

20. The apparatus as set forth in claim 13, further comprising a perforating station for perforating the blister cardboard pack tape.

21. The apparatus as set forth in claim 13, wherein the means for separating the blister cardboard pack tape includes a cutting station for cutting off individual blister cardboard packs from the blister cardboard pack tape transversely to the direction of conveyance.

22. The apparatus as set forth in claim 21, wherein the cutting station is operatively coupled to the following:

suction elements and conveyor means for further conveyance of the individual blister cardboard packs;

a first folding station for folding a first part of the individual blister cardboard packs over a second part of the individual blister cardboard packs;

an inlay station for inserting further inlays in the individual blister cardboard packs;

a second folding station for folding a third part of the individual blister cardboard packs over the first and the second parts of the individual blister packs;

a pusher for stacking several blister cardboard packs; and a pusher for ejecting a stack of several blister cardboard packs into a stacker packing machine.

23. The apparatus as set forth in claim 13, further comprising:

a checking means in the blister pack production machine for detecting defective blister packs and for signalling a cardboard inlay placement device such that it skips a sequence when a defective blister pack reaches the unification station so that no cardboard inlay is placed on the defective blister pack tape, and for signalling the separation means such that it will not operate when such a defective blister pack arrives; and a rejection bin for collecting the defective blister packs downstream of the separation means.

24. The apparatus as set forth in claim 13, further comprising a slitting means for slitting a blister pack tape longitudinally into at least two blister pack tapes, each separate from the other and running parallel to each other.

25. The apparatus as set forth in claim 16, said rotary plate further comprising a folding position for folding one part of the cardboard inlay over another part of the cardboard inlay, and a sealing position for sealing the interfolded parts of the cardboard inlay.

* * * * *